US009109315B2

(12) United States Patent
Tedeschi

(10) Patent No.: US 9,109,315 B2
(45) Date of Patent: Aug. 18, 2015

(54) APPARATUS FOR FEEDING A TUBULAR FABRIC IN A FLATTENED STATE

(75) Inventor: Paolo Tedeschi, Monzuno (IT)

(73) Assignee: BIERREBI ITALIA S.R.L., Pontecchio Marconi (Bologna) (IT)

( * ) Notice: Subject to any disclaimer, the term of this patent is extended or adjusted under 35 U.S.C. 154(b) by 471 days.

(21) Appl. No.: 13/505,575

(22) PCT Filed: Nov. 3, 2009

(86) PCT No.: PCT/IT2009/000496

§ 371 (c)(1),
(2), (4) Date: Jun. 12, 2012

(87) PCT Pub. No.: WO2011/055394

PCT Pub. Date: May 12, 2011

(65) Prior Publication Data

US 2012/0240368 A1 Sep. 27, 2012

(51) Int. Cl.
*D06C 5/00* (2006.01)

(52) U.S. Cl.
CPC ..... *D06C 5/00* (2013.01)

(58) Field of Classification Search
CPC ..... D06C 5/00; D06C 5/005; D06C 3/00; D06F 9/00; D06F 9/06
USPC ..... 26/80, 85, 82, 81, 83, 84, 87, 71, 72; 66/147, 149 R, 150, 151
See application file for complete search history.

(56) References Cited

U.S. PATENT DOCUMENTS 2,189,166 A 2/1940 Samuel et al.
2,294,642 A * 9/1942 Wedler ..... 26/85
2,591,903 A 4/1952 Clarence
2,668,324 A * 2/1954 Johnson ..... 425/327
2,798,515 A 7/1957 York
3,218,829 A * 11/1965 Seiler ..... 66/147
3,337,107 A 8/1967 Frank et al.
3,864,794 A * 2/1975 Baumann ..... 26/82
4,014,187 A * 3/1977 Bandoch et al. ..... 66/147
4,306,341 A * 12/1981 Rottensteiner ..... 26/85

FOREIGN PATENT DOCUMENTS

EP 0 110 129 A2 6/1984

OTHER PUBLICATIONS

International Search Report, dated Jul. 13, 2010, from corresponding PCT application.

* cited by examiner

*Primary Examiner* — Amy Vanatta
(74) *Attorney, Agent, or Firm* — Young & Thompson

(57) ABSTRACT

An apparatus (10) for feeding a tubular fabric (A) in a flattened state includes elements for modifying the flattened configuration of the tubular fabric (A). The elements for modifying the flattened configuration of the tubular material include an upstream part (14) with respective first (13) and second (15) coplanar elements for engaging opposite sides (A1, A2) of the tubular fabric (A) and with respective converging profiles (131, 151), and a downstream part (18) with respective first (17) and second (19) coplanar elements for engaging opposite sides (A3, A4) of the tubular fabric (A), with respective profiles (171, 191) diverging away from the upstream part (14). Actuating elements (120, 122) are provided to move the first and second stretching elements (13, 15 and 17, 19) of the upstream part (14) and the downstream part (14), respectively, relative to each other between respective positions closer together and further apart.

24 Claims, 7 Drawing Sheets

APPARATUS FOR FEEDING A TUBULAR FABRIC IN A FLATTENED STATE

TECHNICAL FIELD

This invention relates to an apparatus for feeding a tubular fabric in a flattened state.

This invention also relates to a quarter turner for modifying the flattened configuration of a tubular fabric and which may be used in a tubular fabric feeding apparatus.

BACKGROUND ART

The modification of the flattened configuration of the tubular fabric is particularly used for feeding tubular fabric cutting machines. In these machines the lateral edges of a fabric tube feeding out of a respective calender, in which the lateral edges of the flattened tube of fabric, which keep a respective permanent crease, must be placed in a suitable fabric cutting area, so as to form an item of clothing in which the permanent crease of the fabric is invisible in the finished item of clothing or garment.

In practice, these feeding means may be advantageously used in combination with a fabric cutting machine used to form respective portions of predefined fabric, to be subsequently assembled to form a finished garment.

Prior art turners designed to modify the flattened configuration of a tubular fabric are known which are provided in apparatuses for feeding a tubular fabric in a flattened state.

These prior art turners comprise a guide body, placed inside the tubular fabric, which have an upper, or upstream, part for stretching the tubular fabric according to a respective plane, and a lower, or downstream, part for stretching the tubular fabric according to a respective plane angularly spaced at 90° to the stretching plane defined by the upper, or upstream, part.

As is known, these upstream and downstream stretching parts have respective first and second coplanar elements for engaging the opposite sides of the tubular fabric and which are reciprocally tapered and convergent towards the downstream and upstream parts, respectively, with the first and second stretching elements of the downstream part angularly spaced at 90° to the first and second stretching elements of the upstream part.

A known problem with regard to these turners for modifying the flattened configuration of the tubular fabric is that, when it is necessary to feed a tubular fabric with a diameter different to that previously processed, it is necessary to modify the reciprocal width or distance between the first and second stretching elements of both the upper part and lower part of the guiding turner. These modifications to the width are currently carried out by the personnel by hand, with a significant waste of time. Indeed, in order to perform these size changeover operations, it is necessary to pull the tubular fabric off the turner, position a new turner with appropriate dimensions, that is, move apart or move together the stretching elements of both the upper and lower parts, and re-fit the tubular fabric over the guiding turner. These are laborious and time-consuming operations that are carried out entirely by hand by personnel.

Another problem found in the use of these turners for modifying the flattened configuration of a tubular fabric is that, in the passage area between a maximum stretching area according to a respective plane and a maximum stretching area of the tubular fabric according to a plane at right angles to the previous one, the fabric tends to form undulated areas in which the fabric is very slack, making it difficult to feed the fabric uniformly and with the risk of obtaining a defective end product.

In other prior art embodiments of these turners for modifying the flattened configuration of a tubular fabric, the fabric is pulled excessively, in the passage area between a maximum stretching area according to a respective plane and a maximum stretching area of the tubular fabric according to the plane at right angles to the previous one, with the risk of obtaining a defective tubular product.

DISCLOSURE OF THE INVENTION

The aim of this invention is to overcome one or more of the above-mentioned shortcomings and/or problems.

An apparatus is provided for feeding a tubular fabric in a flattened state; the apparatus comprises means designed to modify the flattened configuration of the tubular fabric by moving the central portions of the tubular fabric in the flattened configuration upstream in such a way that they form the lateral edges of the same tubular fabric in the flattened configuration downstream; these means which modify the flattened configuration of the tubular material comprise a tubular fabric guide body on which the tubular fabric is placed; the tubular fabric guide body having an upstream part for stretching the tubular fabric according to a respective plane and a downstream part for stretching the tubular fabric according to a respective plane at right angles to the stretching plane defined by the upstream part; the upstream part has respective first and second coplanar elements for stretching and engaging opposite sides of the tubular fabric and which have respective profiles reciprocally symmetrical and convergent towards the downstream part; the downstream part has respective first and second coplanar elements for stretching and engaging opposite sides of the tubular fabric and which have respective profiles reciprocally symmetrical and convergent towards the upstream part, where the first and second stretching elements of the downstream part are at right angles to the first and second stretching elements of the upstream part; characterised in that actuating means are provided for reciprocally moving the first and second stretching elements of the upstream and downstream parts, respectively, of the means for modifying the flattened configuration, between respective positions closer together and further apart.

In this way, it is possible to operate, automatically, on tubular products with different diameters, without having to pull the tubular product off the respective guide means, or turner, and thus saving time and labour.

BRIEF DESCRIPTION OF THE DRAWINGS

This and other innovative aspects of the invention are set out in the appended claims, the technical characteristics and corresponding advantages being apparent from the detailed description below, with reference to the accompanying drawings, which illustrate a non-limiting embodiment provided by way of an example and in which:

DESCRIPTION OF THE PREFERRED EMBODIMENTS OF THE INVENTION

Figure 1:
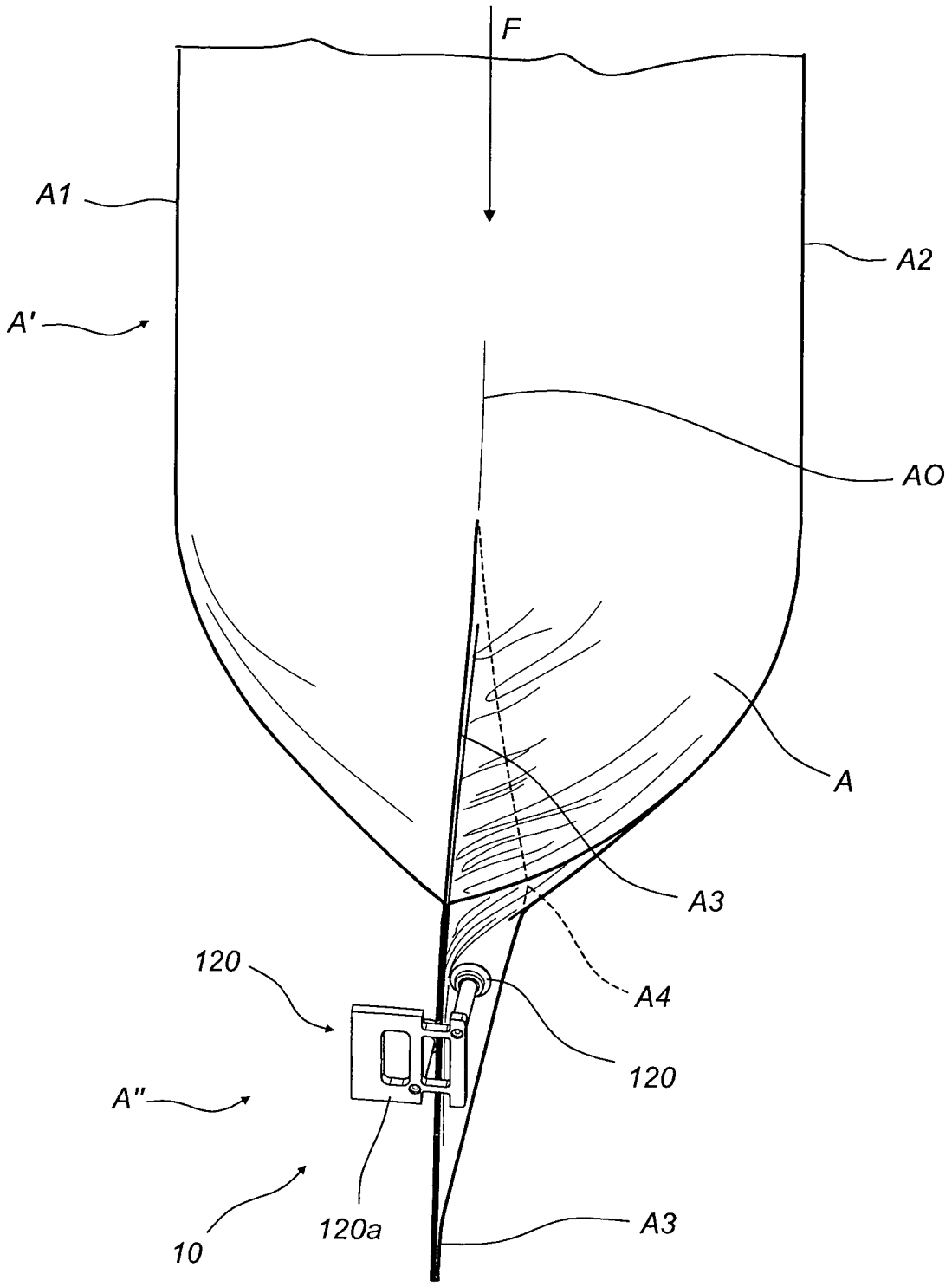
FIG. 1 illustrates a perspective view of the front area of a preferred embodiment of an apparatus for feeding tubular fabric under working conditions.
Figure 2A:
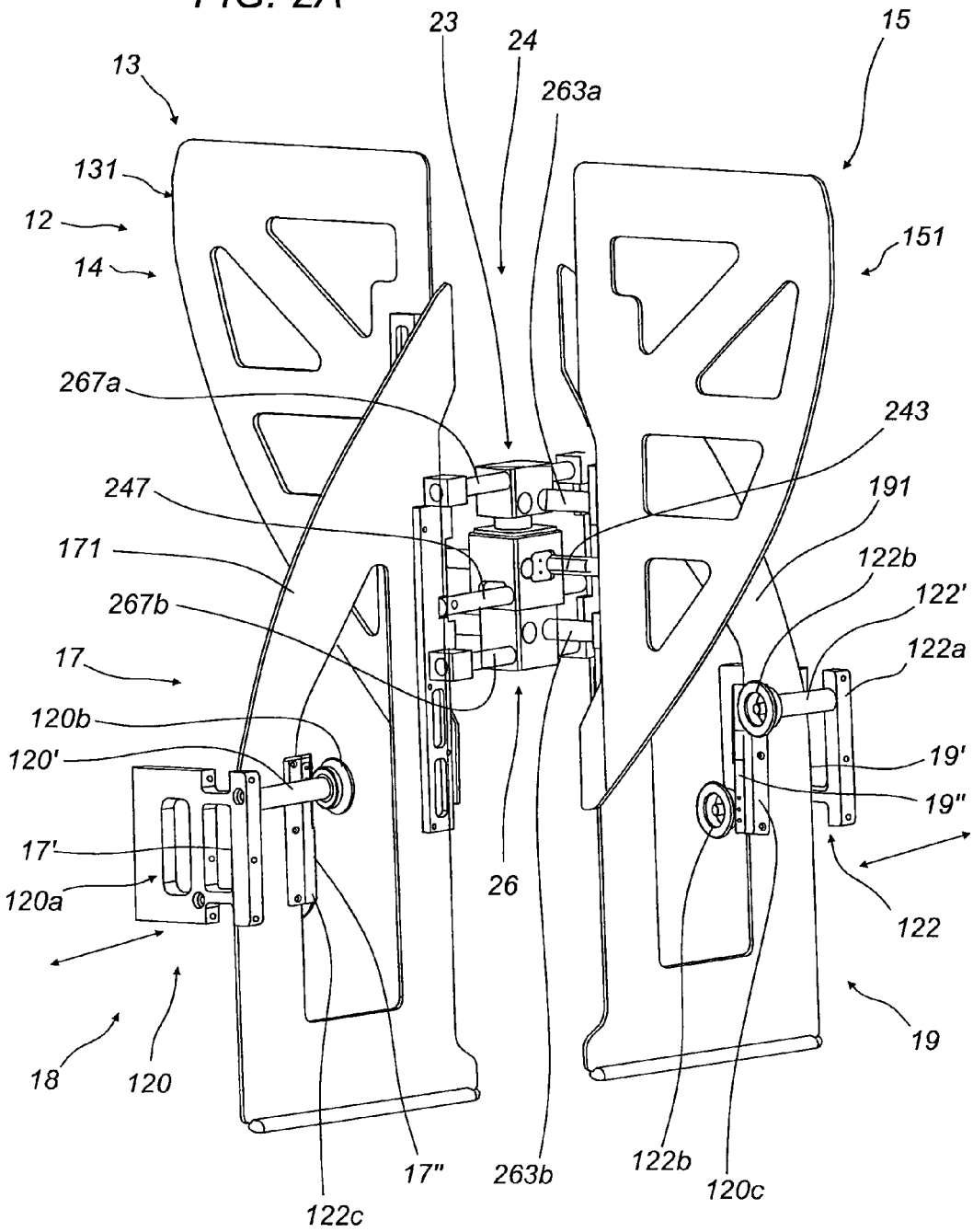
FIG. 2A illustrates a schematic perspective view of a preferred embodiment of the apparatus, showing in particular the turner for modifying the configuration of the flattened fabric and the means for actuating the turner.
Figure 2B:
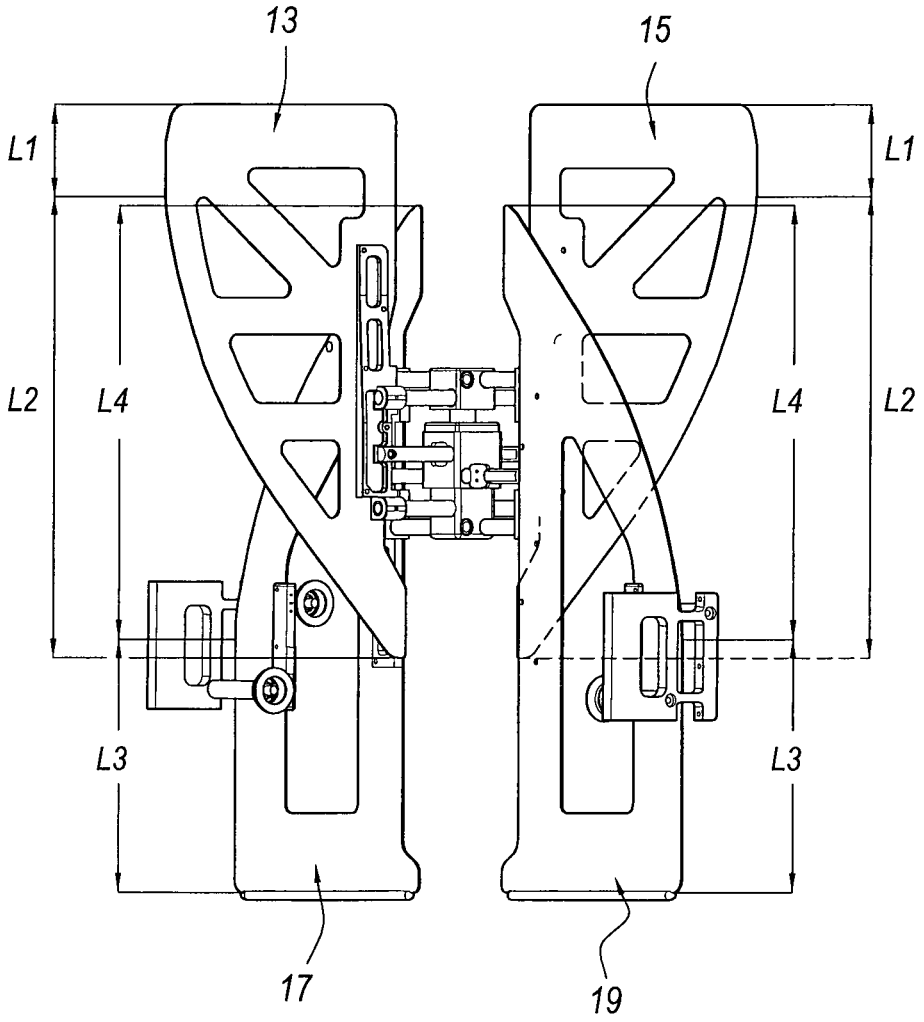
FIG. 2B illustrates a schematic lateral view of a preferred embodiment of the apparatus, showing in particular the turner for modifying the configuration of the flattened fabric and the means for actuating the turner.
Figure 3:
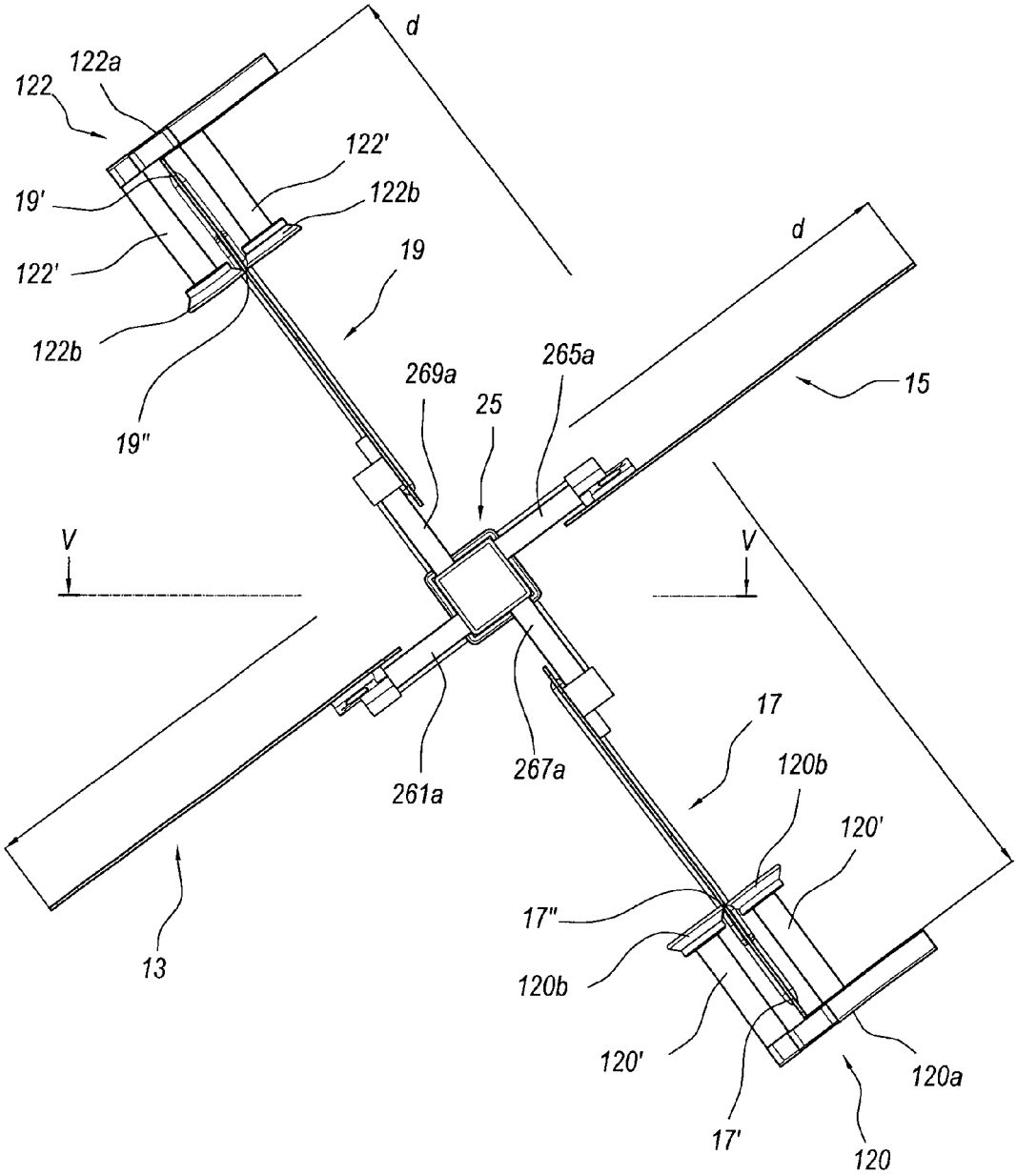
FIG. 3 illustrates a view from above of the preferred embodiment of the apparatus illustrating the fabric guiding turner and the means for actuating it.
Figure 4A:
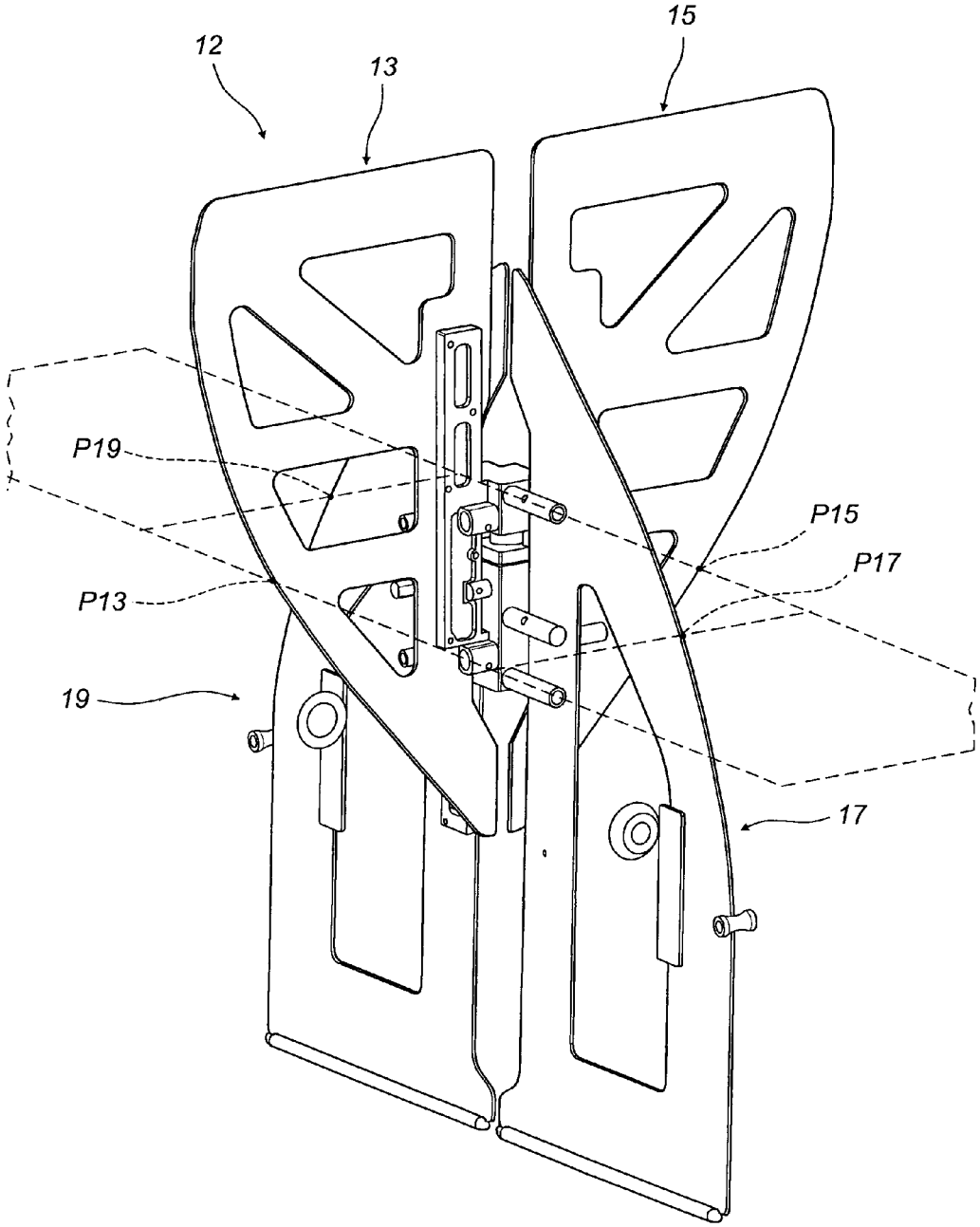
FIG. 4A illustrates a perspective view, taken from a different angle from that of FIG. 2A, and showing only the turner for modifying the flattened configuration of the fabric, in a closed condition, that is, with the fabric stretching elements in a closer together condition.
Figure 4B:
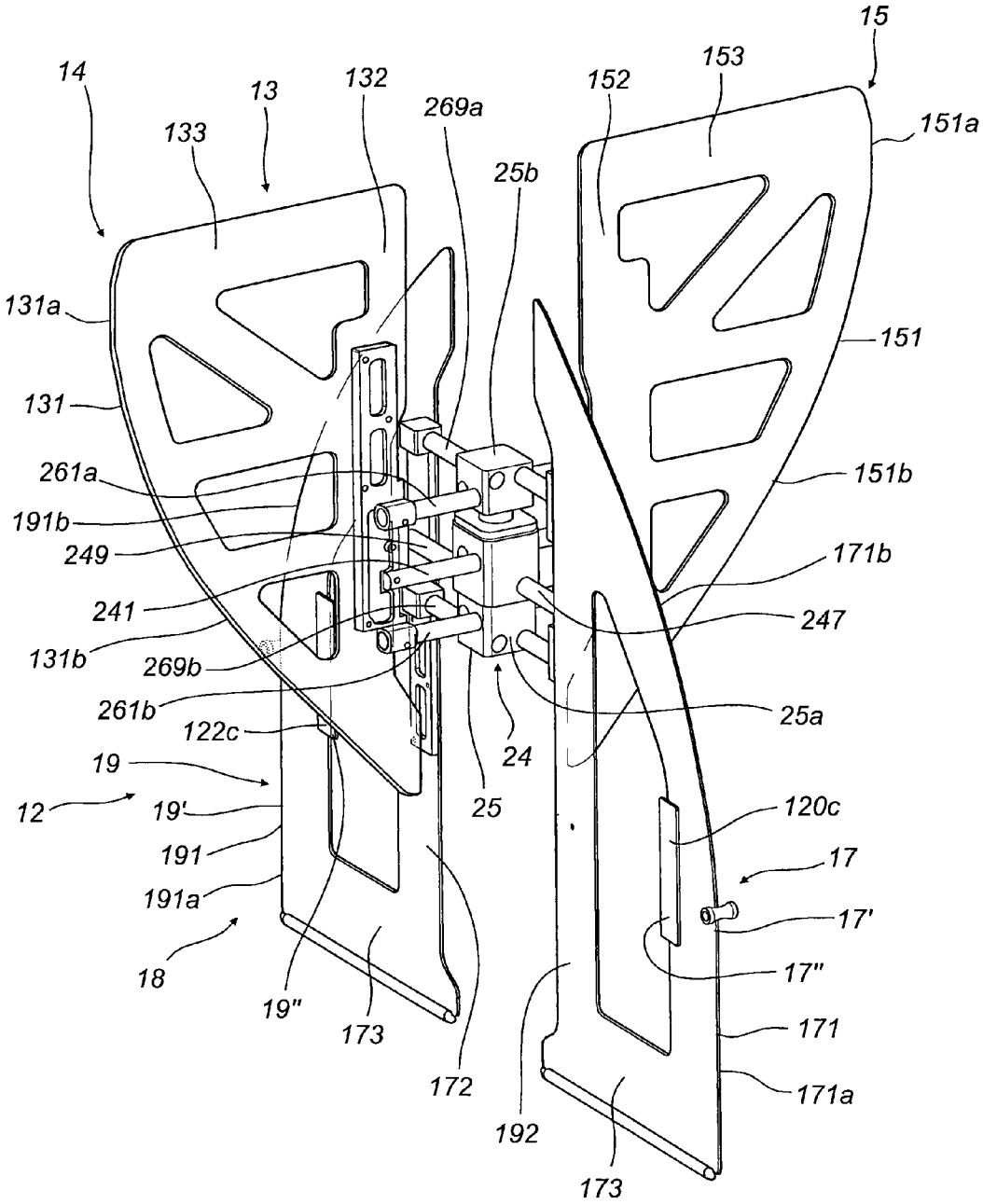
FIG. 4B illustrates a perspective view similar to that of FIG. 4A, with the guiding turner in a further apart condition or having the stretching portions which are reciprocally spaced.

FIGS. 1 to 3 illustrate a preferred embodiment 10 of an apparatus for feeding tubular fabric A in a flattened, or layered, state, which is fed, as shown in FIG. 1, along a respective direction indicated by the arrow F and in particular which is fed forwards from the top to the bottom.

The tubular fabric is run from a special reel of material on which the tubular fabric is wound in a stretched, or flattened, configuration and on which it has respective lateral edges labelled A1 and A2 in FIG. 1.

Looking in more detail, the apparatus 10 comprises means designed to modify the flattened configuration of the tubular fabric A being fed, by moving the central portions A0 of the opposing or facing layers of the tubular fabric, which extend between the opposite lateral edges A1, A2 of the upstream portion A' of tubular fabric, so that they become the lateral edges A3, A4 of the downstream flattened portion A" of the tubular fabric A.

In this way, the lateral edges A1 and A2 of the upstream flattened configuration A' form the central part of the opposing layers of the downstream flattened configuration A" of the tubular fabric A.

As shown more clearly in FIGS. 2A and 3, the means designed to modify the flattened configuration of the tubular material comprise a guide body 12, on which the tubular A moving forwards is placed.

The guide body 12 of the tubular fabric A has an upper, or upstream, part 14 for stretching the tubular fabric according to a respective plane and a lower, or downstream, part 18 for stretching the tubular fabric A according to a respective plane which is angularly spaced by 90° from the stretching plane formed by the upper, or upstream, part 14.

As illustrated, the upstream part 14 of the tubular fabric guide body has respective first, 13, and second, 15, coplanar elements engaging the opposite sides A1, A2 of the tubular fabric A, the first and second elements 13, 15 having respective profiles 131, 151 which are reciprocally symmetrical and convergent towards the downstream part 18 of the guide body, or according to the forward movement direction F of the fabric.

In turn, the downstream part 18 of the tubular fabric guide body has respective first, 17, and second, 19, coplanar elements engaging the opposite sides A3, A4 of the tubular fabric A, the elements 17, 19 having respective profiles 171, 191 which are reciprocally symmetrical and divergent away from the upstream part 14, that is, according to the forward movement direction F of the tubular fabric. In practice, the profiles 171, 191 are reciprocally symmetrical and convergent towards the upstream part 14.

As illustrated, the first and second stretching, or engagement, elements 17, 19 of the downstream part 18 are angularly spaced by an angle equal, or substantially equal, to 90° from, that is, they are at right angles, or substantially at right angles to, the first and second extension elements 13, 15 of the upper part 14 of the guide means of the tubular fabric A.

Advantageously, the apparatus comprises actuating means 120, 122 which are designed to move, reciprocally, the first and second stretching elements of the tubular fabric A of the upstream part and of the downstream part, respectively, between respective positions closer together and further apart, in such a way that it is possible to operate on tubular fabric with different diameters without the need, as is the case with prior art solutions, to remove the tubular fabric from the means for modifying the flattened configuration of the tubular fabric, move the stretching elements by hand, and, then, re-fit the tubular fabric on the stretching elements, in order to continue the processing.

By providing specific actuating means, size changeover is automated and it is no longer necessary to pull out and re-fit the fabric on the turner.

Looking in more detail, the actuating means 120, 122 are designed to move the first and second stretching elements 13, 15 and 17, 19, of the upstream part 14 and of the downstream part 18 relative to each other simultaneously.

In particular, the actuating means 120, 122 operate directly on the first and second stretching elements 17, 19 of a respective part, in particular the downstream part 18, of the means 12 for modifying the flattened configuration of the tubular fabric A.

Means 24 are advantageously provided for transmitting the movement, imparted by the actuating means 120, 122 to the first and second stretching elements 17, 19 of a respective part of the means 12 for modifying the flattened configuration of the tubular fabric A, also to the first and second stretching elements 13, 15 of the other part of the means 12 for modifying the flattened configuration of the tubular fabric A.

In particular, means 24 are provided for transmitting movement to the first and second stretching elements 13, 15 of the upstream part 14 of the means 12 for modifying the flattened configuration, so that the first and second stretching elements 13, 15 of the upstream part move further apart and closer together simultaneously with the reciprocal moving further apart and closer together of the first and second stretching elements 17, 19 of the downstream part 18.

It may be seen how, in practice, the first and second stretching elements 17, 19 of the downstream part 18 form means for moving the stretching elements 13, 15 of the upstream part 14 of the means 12 for modifying the flattened configuration of the tubular fabric A.

From another point of view, the first and second stretching elements 17, 19 of a part 18 of the means 12 for modifying the flattened configuration of the tubular fabric are operatively connected to the first and second stretching elements 13, 15 of the other part 14 of the means 12 for configuring the flattened position, to move the first and second stretching elements 13, 15 of the other part 14, along a direction at right angles to the direction of movement of the stretching elements 17, 19 of the downstream part 18.

The means 24 for transmitting movement comprise a respective rack 241, 243, 247, 249 fixed to the respective stretching element 13, 15, 17, 19 and extending from this transversally to the forward movement direction F of the fabric A.

Figure 5:
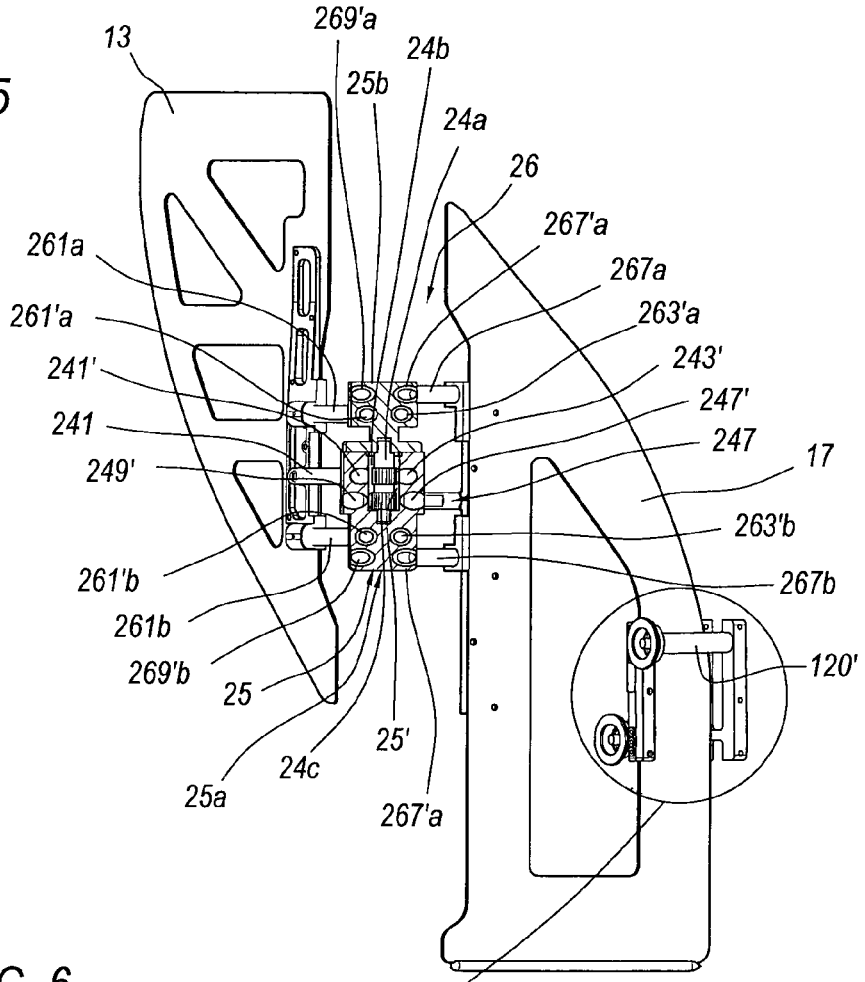
FIG. 5 illustrates a sectional view along line V-V of FIG. 3 of the preferred embodiment of the apparatus to modify the configuration of the tubular fabric.
Figure 6:
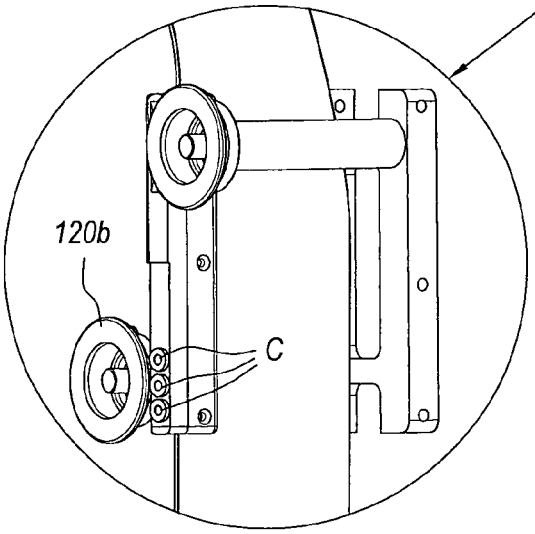
FIG. 6 illustrates a detail of the internal area where the actuating means engage the fabric guide profile.

In addition, the transmission means 24 comprise a transmission shaft, labelled 24*a* in FIG. 5, vertical, or extending along the feed direction F of the fabric, which has respective first and second crown gears 24*b*, 24*c* meshing with driven racks 241, 243, and drive racks 247, 249, respectively, which are fixed to the stretching elements 13, 15, 17, 19 of the tubular fabric A.

The transmission means 24 are supported by a respective vertical block 25, which has an inner cavity 25' for housing the transmission shaft 24*a*.

The support block 25 has respective transversal sliding channels, or seats, 241', 243', 247', 249' for the respective movement racks 241, 243, 247, 249.

There are also means 26 for guiding the transversal movement of the stretching elements 13, 15, 17, 19.

The guide means comprise a respective rod for guiding the respective stretching element 13, 15, 17, 19 and, in particular, comprise a respective first and second guide rod 261*a*, 261*b*, 263*a*, 263*b*, 267*a*, 267*b*, 269*a*, 269*b* for the respective stretching element 13, 15, 17, 19.

As shown, the respective rack 241, 243, 247, 249 of the respective stretching element 13, 15, 17, 19 extends between the first guide rod 261*a*, 261*b*, 263*a*, 263*b*, 267*a*, 267*b*, 269*a*, 269*b* of the respective stretching element 13, 15, 17, 19.

As shown, the respective guide rod is fixed to the respective stretching element 13, 15, 17, 19 and it protrudes from the support block 25 sliding in corresponding channels, or transversal seats, labelled 261'*a*, 261'*b*, 263'*a*, 263'*b*, 267'*a*, 267'*b*, 269'*a*, 269'*b*, formed in the block 25.

As shown, the support block 25 has a first part 25*a*, in which the housing cavity 25' is formed, which is open at an upper end, where there is a second part 25*b* of the block 25 which is suitably fixed to the first part 25*a* of the same block 25 to close the opening for inserting the shaft inside the seat 25'.

Advantageously, the actuating means 120, 122 are designed to move the first and second stretching elements 13, 15 and 17, 19 relative to each other, with the respective tubular fabric A interposed between them.

Looking in more detail, the actuating means comprise a first and a second body for coupling the respective stretching element 17, 19, which move relative to each other from a closer together position for narrowing the turner 13 to a further apart position for widening the turner 12 and vice versa.

The actuating means, in particular the first and second coupling body, comprise respective means of bilateral engagement for opposite surfaces of the respective stretching element 17, 19.

As shown, the respective coupling body of the actuating means comprises a crossbar 120*a*, 122*a* for engaging an outer surface 17', 19' of the respective stretching elements 17, 19.

In addition, the respective coupling body of the actuating means 120, 120*b* comprises a pad, in particular a first and a second pad 120*b*, 120*b*, 122*b*, 122*b*, for engaging an inner surface 17", 19" of the respective stretching element 17, 19, in particular for engaging an inner surface of the outer curved portion of the respective stretching element 17, 19, which will be more clearly described below.

The actuating means 120, 122 comprise a respective conical pad 120*b*, 120*b*, 122*b*, 122*b* for engaging an inner surface 17", 19" of the respective stretching element 17, 19, which is supported by a respective shaft 120', 122' extending from the respective engagement cross-bar 120*a*, 122*a* of the outer surface 17', 19' of the respective outer tapered portion of the respective stretching element 17, 19, the shafts 120', 122' being on the opposite sides of the outer tapered portion of the respective stretching element 17, 19.

The inner engagement surface of the respective stretching element 17, 19 is in the form of a block 120*c*, 122*c* forming a widened engagement surface and it is attached to the respective stretching element 17, 19.

In practice, the block 120*c*, 122*c* forms an engagement surface designed to avoid the tearing, or damaging, of the fabric, which is placed between the engagement means and the tubular fabric stretching elements.

On the respective stretching element 17, 19, in particular on the block 120*c*, 122*c*, at the area of contact with the respective engagement pad 120*b*, 120*b*, 122*b*, 122*b* of the actuating means, there are revolving means, in particular bearings C, with the fabric passing between the pads and the revolving means, to facilitate the sliding of the fabric.

As shown, the respective stretching element 13, 15, 17, 19 comprises a suitably tapered outer portion 131, 151, 171, 191 which has a respective end convergent to and joining the end of a linear, or vertical, inner portion 132, 152, 172, 192 of the same stretching element 13, 15, 17, 19.

The respective stretching element 13, 15, 17, 19 also comprises an end transversal portion 133, 153, 173, 193, positioned at the opposite end to the joining end between the inner linear portion and the outer tapered portion, the end transversal portion 133, 153, 173, 193 joining together the inner linear portion and the tapered portion 131, 151, 171, 191.

The upstream stretching elements 13, 15 also comprise a plurality of transversal and oblique elements, joining together the linear portion 132, 152, 162, 192 and the outer tapered portion 131, 151, 171, 191 of the respective stretching element.

It is clear, in particular from FIG. 3, that the respective stretching element 13, 15, 17, 19 takes the form of a slender, or thin, body, which is in particular made from a corresponding piece of sheet metal which has a suitable shape imparted to it, that is to say, it is in the form of a shaped metal plate.

Advantageously, the outer tapered portion 131, 151, 171, 191 of the respective stretching element 13, 15, 17, 19 has an end linear section 131*a*, 151*a*, 171*a*, 191*a*, from which a tapered section 131*b*, 151*b*, 171*b*, 191*b* extends, converging towards the inner part, in which the end linear section 131*a*, 151*a*, 171*a*, 191*a* has a length, or height, L1, L3, which is less than the length, or height, L2, L4 of the tapered section 131*b*, 151*b*, 171*b*, 191*b*.

In this way, it is possible to define a passage section from the upper, or upstream, part 14 to the lower, or downstream, part 18, that is quite large, which is advantageous for a more uniform flattening of the tubular fabric in this passage area.

In addition, the first and second stretching element 13, 15, 17, 19 of the upstream part 14 and of the downstream part 18 advantageously has a respective linear section 131*a*, 151*a*, 171*a*, 191*a* and a tapered section 131*b*, 151*b*, 171*b*, 191*b* that intersects the tapered section of the other part such that the tapered parts 131*b*, 151*b*, 171*b*, 191*b* are designed to form, on corresponding planes transversal to the forward movement direction F of the fabric A, respective points p13, p15, p17, p19 for engaging and sliding the tubular fabric such that the sum of the distances between the contact points p13, p15, p17, p19 is equal to, or substantially equal to, twice the distance "d" between the opposite sliding points on the linear sections 131*a*, 151*a*, 171*a*, 191*a* of the stretching element 13, 15, 17, 19 of the upstream part 14 and of the downstream part 18.

In this way, the stretching of the tubular fabric also in the passage area between the upstream part and the downstream part of the turner is kept uniform or substantially uniform, avoiding any risk of damaging the product.

A turner, or means, 12 is therefore provided designed to modify the flattened configuration of a tubular fabric, which enables the configuration of the turner to be adapted to the diameter of the tubular fabric without the need for manual adjustment, in particular by pulling out the tubular fabric, modifying the configuration of the turner and re-fitting the tubular fabric on the same turner, as was the case with prior art solutions.

The invention described herein is susceptible of industrial application. It would be obvious to a person skilled in the art that several changes and modifications can be made to the invention described with reference to the specific preferred embodiment of it without departing from the spirit and scope of the invention, described in detail above. In particular, the person skilled in the art may easily imagine other preferred embodiments of the invention which comprise one or more of the above-indicated characteristics. Moreover, all the details of the invention may be substituted by equivalent elements.

The invention claimed is:

1. An apparatus for feeding a tubular fabric in a flattened state, comprising:

a tubular fabric guide body designed to modify a flattened configuration of the tubular fabric by moving central portions of an upstream flattened configuration of the tubular fabric so that the central portions become lateral edges of a downstream flattened portion of the tubular fabric;

an upstream part of the tubular fabric guide body configured for stretching the tubular fabric according to a respective plane; and a downstream part of the tubular fabric guide body configured for stretching the tubular fabric according to a respective plane at right angles to the stretching plane defined by the upstream part;

respective first and second coplanar stretching elements of the upstream part configured to stretch and engage opposite sides of the tubular fabric and which have respective profiles reciprocally symmetrical and convergent towards the downstream part; and respective first and second coplanar stretching elements of the downstream part configured to stretch and engage the lateral edges of the tubular fabric and which have respective profiles reciprocally symmetrical and convergent towards the upstream part, wherein the first and second coplanar stretching elements of the downstream part are at right angles to the first and second coplanar stretching elements of the upstream part, an actuator is provided for moving the first and second coplanar stretching elements, respectively, of the tubular fabric guide body, relative to each other between respective positions closer together and further apart, and the first and second coplanar stretching elements of a part of the tubular fabric guide body are operatively connected to the first and to the second tubular fabric guide body stretching elements of the other part of tubular fabric guide body, to move the first and second coplanar stretching elements of the other part in a direction at right angles to a direction of movement of the stretching elements of the part of the tubular fabric guide body.

2. The apparatus according to claim 1, wherein the actuator is provided for moving the first and second stretching elements of the upstream part and of the downstream part simultaneously.

3. The apparatus according to claim 1, wherein the actuator is designed to move the first and the second coplanar stretching elements of an upstream part of the tubular fabric guide body upstream of a fabric feed direction, and wherein the actuator is designed to move the first and the second elements of the downstream part of the tubular fabric guide body downstream of the fabric feed direction.

4. The apparatus according to claim 1, wherein a transmission is configured to transmit movement from the first and second coplanar stretching elements of the downstream part of tubular fabric guide body to the first and second coplanar stretching elements of the upstream part of the tubular fabric guide body.

5. The apparatus according to claim 4, wherein the transmission transmits movement to the first and to the second coplanar stretching elements of the upstream part of the tubular fabric guide body.

6. The apparatus according to claim 4, wherein the transmission comprises a respective rack integral with the respective coplanar stretching element.

7. The apparatus according to claim 4, wherein the transmission comprises a transmission shaft having respective first and second crown gears engaging with respective movement racks.

8. The apparatus according to claim 4, wherein the transmission comprises a respective support block for housing a transmission shaft.

9. The apparatus according to claim 4, wherein the transmission comprises a respective support block having transversal sliding channels for respective movement racks.

10. The apparatus according to claim 1, wherein guides are provided for guiding the movement of the stretching elements.

11. The apparatus according to claim 10, wherein the guides comprise a respective rod for guiding the respective stretching element.

12. The apparatus according to claim 10, wherein the guides comprise respective first and second guide rods of the respective stretching element.

13. The apparatus according to claim 10, wherein a respective actuating rack extends between a first and a second guide rod of the respective coplanar stretching element.

14. The apparatus according to claim 10, wherein a respective guide rod is integral with the respective coplanar stretching element and slides inside a corresponding hole of a support block.

15. The apparatus according to claim 1, further comprising a support block having a first part forming a housing open at one end which is closed by a second part of the support block fixed to the first part.

16. The apparatus according to claim 1, wherein the actuator is configured for moving the first and second coplanar stretching elements relative to each other with the respective tubular fabric interposed between them.

17. The apparatus according to claim 1, the actuator comprises a first and a second body for engaging the respective coplanar stretching element and which are movable relative to each other from a closer together position to a further apart position and vice versa.

18. The apparatus according to claim 1, wherein the actuator is configured for bilaterally engaging the respective coplanar stretching element.

19. The apparatus according to claim 1, wherein the actuator comprises a crossbar for engaging an outer surface of the respective coplanar stretching element.

20. The apparatus according to claim 1, wherein the actuator comprises a pad for engaging an inner surface of the respective coplanar stretching element.

21. The apparatus according to claim 1, wherein an inner engagement surface of the respective coplanar stretching element is in the form of a block integral with the respective coplanar stretching element.

22. The apparatus according to claim 1, wherein the respective coplanar stretching element comprises an outer tapered portion, wherein the respective coplanar stretching element comprises an inner linear portion, the and an outer tapered portion having an end convergent to and joining an end of the inner linear portion, wherein the respective coplanar stretching element comprises an end transversal portion joining the inner linear portion and the outer tapered portion, wherein the respective coplanar stretching element has a slender, or thin, body and wherein the respective coplanar stretching element is a shaped plate.

23. An apparatus for feeding a tubular fabric in a flattened state, comprising:

a tubular fabric guide body designed to modify a flattened configuration of the tubular fabric by moving central portions of an upstream flattened configuration of the tubular fabric so that the central portions become lateral edges of a downstream flattened portion of the tubular fabric;

an upstream part of the tubular fabric guide body configured for stretching the tubular fabric according to a respective plane; and a downstream part of the tubular fabric guide body configured for stretching the tubular fabric according to a respective plane at right angles to the stretching plane defined by the upstream part;

respective first and second coplanar stretching elements of the upstream part configured to stretch and engage opposite sides of the tubular fabric and which have respective profiles reciprocally symmetrical and convergent towards the downstream part (16); and respective first and second coplanar stretching elements of the downstream part configured to stretch and engage the lateral edges of the tubular fabric and which have respective profiles reciprocally symmetrical and convergent towards the upstream part, wherein the first and second coplanar stretching elements of the downstream part are at right angles to the first and second coplanar stretching elements of the upstream part, an actuator provided for moving the first and second coplanar stretching elements, respectively, of the tubular fabric guide body, relative to each other between respective positions closer together and further apart, wherein the actuator comprises a pad for engaging an inner surface of the respective coplanar stretching element, and the actuator comprises a first and a second pad for engaging an inner surface of the respective coplanar stretching element and which are provided on the opposite sides of the respective coplanar stretching element, and wherein the actuator further comprises a respective pad for engaging the inner surface of the respective coplanar stretching element which is supported by a respective shaft extending from a crossbar that engages the outer surface of the respective coplanar stretching element.

24. An apparatus for feeding a tubular fabric in a flattened state, comprising:

a tubular fabric guide body designed to modify a flattened configuration of the tubular fabric by moving central portions of an upstream flattened configuration of the tubular fabric so that the central portions become lateral edges of a downstream flattened portion of the tubular fabric;

an upstream part of the tubular fabric guide body configured for stretching the tubular fabric according to a respective plane; and a downstream part of the tubular fabric guide body configured for stretching the tubular fabric according to a respective plane at right angles to the stretching plane defined by the upstream part;

respective first and second coplanar stretching elements of the upstream part configured to stretch and engage opposite sides of the tubular fabric and which have respective profiles reciprocally symmetrical and convergent towards the downstream part (16); and respective first and second coplanar stretching elements of the downstream part configured to stretch and engage the lateral edges of the tubular fabric and which have respective profiles reciprocally symmetrical and convergent towards the upstream part, wherein the first and second coplanar stretching elements of the downstream part are at right angles to the first and second coplanar stretching elements of the upstream part, an actuator provided for moving the first and second coplanar stretching elements, respectively, of the tubular fabric guide body, relative to each other between respective positions closer together and further apart, wherein an outer tapered portion of the respective coplanar stretching element has an end linear section from which a tapered section (131*b*, 151*b*, 171*b*, 191*b*) extends, where the end linear section has a length less than a length of the tapered section, and wherein the first and second coplanar stretching elements of the upstream part and of the downstream part each have a respective linear section and a tapered section that intersect with the tapered section of the corresponding other upstream or downstream part, such that the tapered parts 191*b*) are designed to form on corresponding planes transverse to a forward movement direction of fabric at respective points on the tapered sections for engaging and sliding of the tubular fabric such that a sum of distances between contact points is equal, or substantially equal, to twice a distance between opposite sliding points on the linear sections of the coplanar stretching elements upstream and downstream.

* * * * *